US008177353B2

(12) United States Patent
Kawabata

(10) Patent No.: US 8,177,353 B2
(45) Date of Patent: May 15, 2012

(54) SHEET TRANSPORT DEVICE AND IMAGE FORMING APPARATUS

(75) Inventor: Kenichi Kawabata, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 1102 days.

(21) Appl. No.: 11/893,806

(22) Filed: Aug. 17, 2007

(65) Prior Publication Data

US 2008/0050135 A1 Feb. 28, 2008

(30) Foreign Application Priority Data

Aug. 23, 2006 (JP) ..... 2006-227097

(51) Int. Cl.
*B41J 2/01* (2006.01)

(52) U.S. Cl. ..... 347/104; 347/101

(58) Field of Classification Search ..... None
See application file for complete search history.

(56) References Cited

U.S. PATENT DOCUMENTS

| | | | | |
|---|---|---|---|---|
| 6,499,841 | B1 * | 12/2002 | Uchida et al. | 347/104 |
| 7,496,326 | B2 | 2/2009 | Kawabata | |
| 2006/0055754 | A1 * | 3/2006 | Sakuma et al. | 347/101 |
| 2006/0132574 | A1 * | 6/2006 | Kawabata | 347/104 |
| 2007/0064032 | A1 | 3/2007 | Kawabata | |
| 2007/0120936 | A1 | 5/2007 | Kawabata | |

FOREIGN PATENT DOCUMENTS

| | | |
|---|---|---|
| JP | 4-16438 | 1/1992 |
| JP | 4-159937 | 6/1992 |
| JP | 2000-272107 | 10/2000 |
| JP | 2002-302285 | 10/2002 |
| JP | 3487715 | 10/2003 |
| JP | 2004-351682 | 12/2004 |
| JP | 2005-132538 | 5/2005 |
| JP | 2005-231814 | 9/2005 |
| JP | 2005-280942 | 10/2005 |
| JP | 2006-176261 | 7/2006 |

OTHER PUBLICATIONS

Dec. 14, 2010 Japanese official action in connection with a counterpart Japanese patent application.

* cited by examiner

*Primary Examiner* — Matthew Luu
*Assistant Examiner* — Kendrick Liu
(74) *Attorney, Agent, or Firm* — Cooper & Dunham LLP

(57) ABSTRACT

A sheet transport device and an image forming apparatus using the sheet transport device are disclosed. The sheet transport device includes a transport belt rotating around rollers that transports a sheet by attaching the sheet to the transport belt by an electrostatic force, and a charging unit that is unitized by including a charging member for charging the transport belt. The charging unit includes a unit case containing springs for pushing the charging member onto the transport belt. An Ac bias voltage is applied to the transport belt via the charging member.

18 Claims, 15 Drawing Sheets

FIG.16

| | PHENOMENON 1 | PHENOMENON 2 |
|---|---|---|
| MONITORED LEAKAGE CURRENT VALUE | × | × |
| UNCLEAN SIGNAL DETECTED BY UNCLEAN DETECTION SENSOR | × | ○ |
| DISPLAY | UNCLEANNESS DETECTION (WARNING) | LEAKAGE CURRENT DETECTION (MESSAGE) |

SHEET TRANSPORT DEVICE AND IMAGE FORMING APPARATUS

BACKGROUND

1. Technical Field

This disclosure generally relates to a sheet transport device which transports a sheet by using an electrostatic force and an image forming apparatus using the sheet transport device.

2. Description of the Related Art

As an image forming apparatus such as a printer, a facsimile, a copier, a plotter, and a multifunctional apparatus that has the above functions, for example, there is an apparatus using a liquid ejecting device having a liquid ejecting head which ejects recording liquid (ink) onto a recording medium for forming an image on the recording medium. The recording medium is not limited to a sheet, and other recording media such as an image transferring medium and recording paper can be used as the recording medium; and as the image forming, image recording, image printing, letter printing, letter transferring and so on are included.

The image forming apparatus forms an image on a recording medium formed of materials such as paper, thread, string, cloth, glass, wood, plastic, metal, and ceramics by ejecting recording liquid onto the recording medium by using an electrophotographic system or other systems. Further, the image forming includes attaching an image such as a pattern onto a recording medium in addition to attaching an image having a meaning such as a letter and a figure onto the recording medium. The recording liquid is not limited to ink and can be fluid to be ejected.

Generally, the image forming apparatus having the liquid ejecting device provides a sheet transport device including a transport belt which transports a sheet by using an electrostatic force so as to maintain flatness of the sheet.

In Patent Document 1, a transfer belt device of an image forming apparatus is disclosed. The transfer belt device provides an endless type transfer belt which is wound around plural rollers and driven by the rollers, and transports a transfer sheet from an upstream side to a downstream side of a photoconductor body by attaching the transfer sheet on the transfer belt by the electrostatic force. A driving roller in the plural rollers contacts the sheet transport surface of the transfer belt, and a cleaning member contacts the surface of the driving roller. The cleaning member is held by a holding member which is a part of a case, and the holding member is detachably attached to the case.

[Patent Document 1] Japanese Patent No. 3487715 (Japanese Laid-Open Patent Application No. 9-292783)

Since the transport belt in the belt transport device always contacts a charging member (charging unit), liquid such as ink may be attached onto the transport belt and a water droplet when dew condensation occurs may be attached onto the charging member while rotating the transport belt. When the liquid or the water droplet is attached onto the transport belt, the resistance value of the charging member may be lowered. Consequently, a current value from a high-voltage power source rises (under the constant voltage control) and a leakage current may be generated.

In a case where a leakage current is generated by attaching liquid onto the transport belt, when the water (liquid) is evaporated, the belt transport device returns to normal operating conditions. However, depending on the type of the liquid, especially, when high viscosity ink which is hardly dried is used, it takes a long time to return to the normal operating conditions because the ink hardly dries.

BRIEF SUMMARY

In an aspect of this disclosure, there is provided a sheet transport device, and an image forming apparatus using the sheet transport device, configured to allow a charging unit to be easily cleaned.

In another aspect of this disclosure, there is provided a sheet transport device that includes a transport belt rotating around rollers that transports a sheet by attaching the sheet on the transport belt by an electrostatic force, a charging unit including a charging member that charges the transport belt and a pressure applying unit that applies pressure to the charging member toward the transport belt so that the charging member contacts the transport belt. The charging unit can be detached from or attached to the sheet transport device as one unit.

According to another aspect, there is provided an image forming apparatus that includes a sheet transport device including a transport belt rotating around rollers that transports a sheet by attaching the sheet on the transport belt by an electrostatic force, a charging unit including a charging member that charges the transport belt and a pressure applying unit that applies pressure to the charging member toward the transport belt so that the charging member contacts the transport, and an image forming unit configured to form an image on the sheet transported by the sheet transport device. The charging unit can be detached from or attached to the sheet transport device as one unit.

According to another aspect, a sheet transport device includes a transport belt rotating around rollers that transports a sheet by attaching the sheet to the transport belt by an electrostatic force and a charging unit that is unitized by including a charging member for charging the transport belt. Therefore, the charging member can be easily cleaned by removing the charging unit.

BRIEF DESCRIPTION OF THE DRAWINGS

The aforementioned and other aspects, features and advantages will become more apparent from the following detailed description when read in conjunction with the accompanying drawings, in which:

FIG. 16 is a table showing a monitored leakage current value shown in FIG. 14 and a detected unclean signal shown in FIG. 15.

DESCRIPTION OF THE PREFERRED EMBODIMENTS

Best Mode of Carrying Out the Invention

The best mode of carrying out the present invention is described with reference to the accompanying drawings.

First Embodiment

Figure 1:
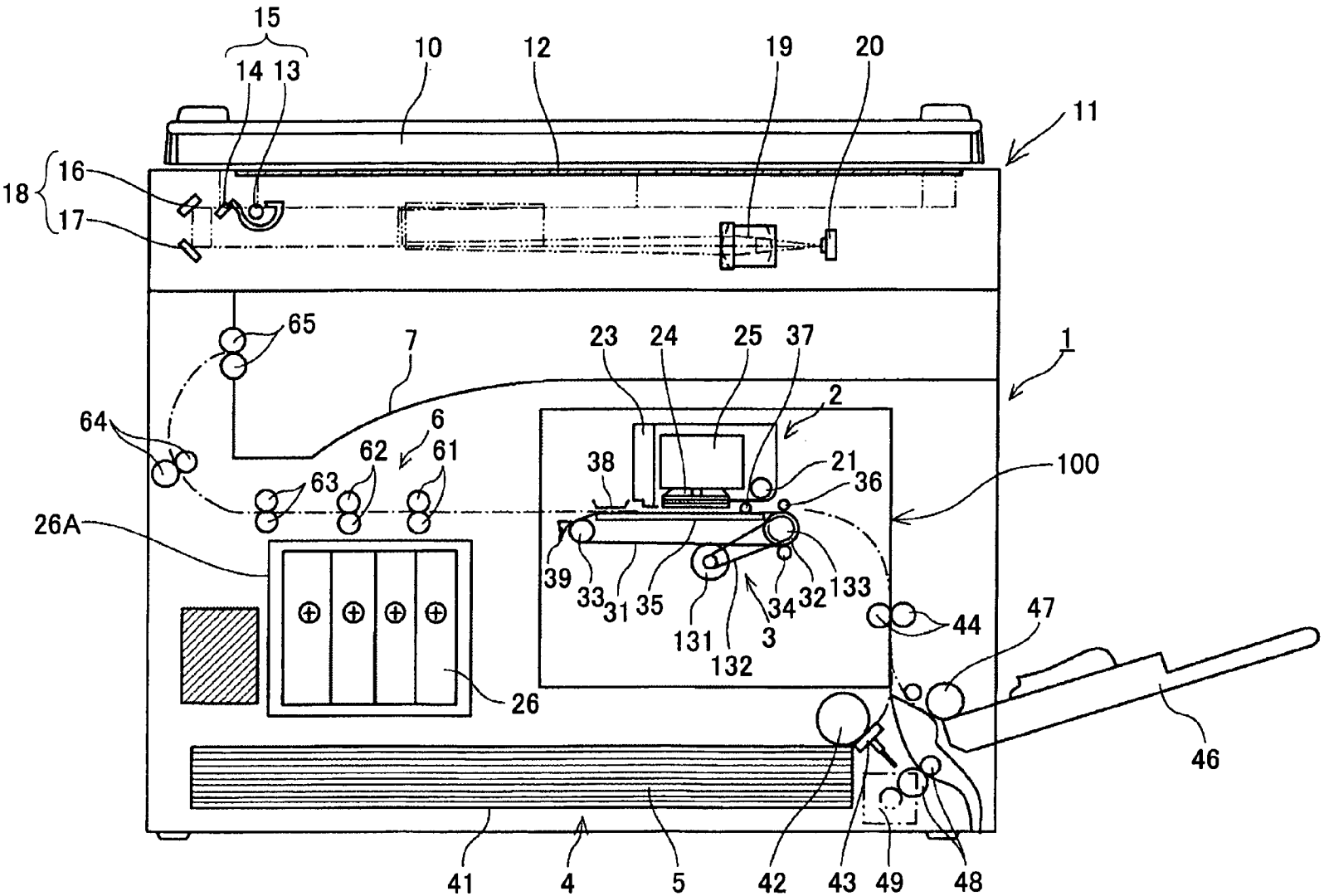
FIG. 1 is a schematic diagram showing a structure of an image forming apparatus according to a first embodiment of the present invention.
Figure 2:
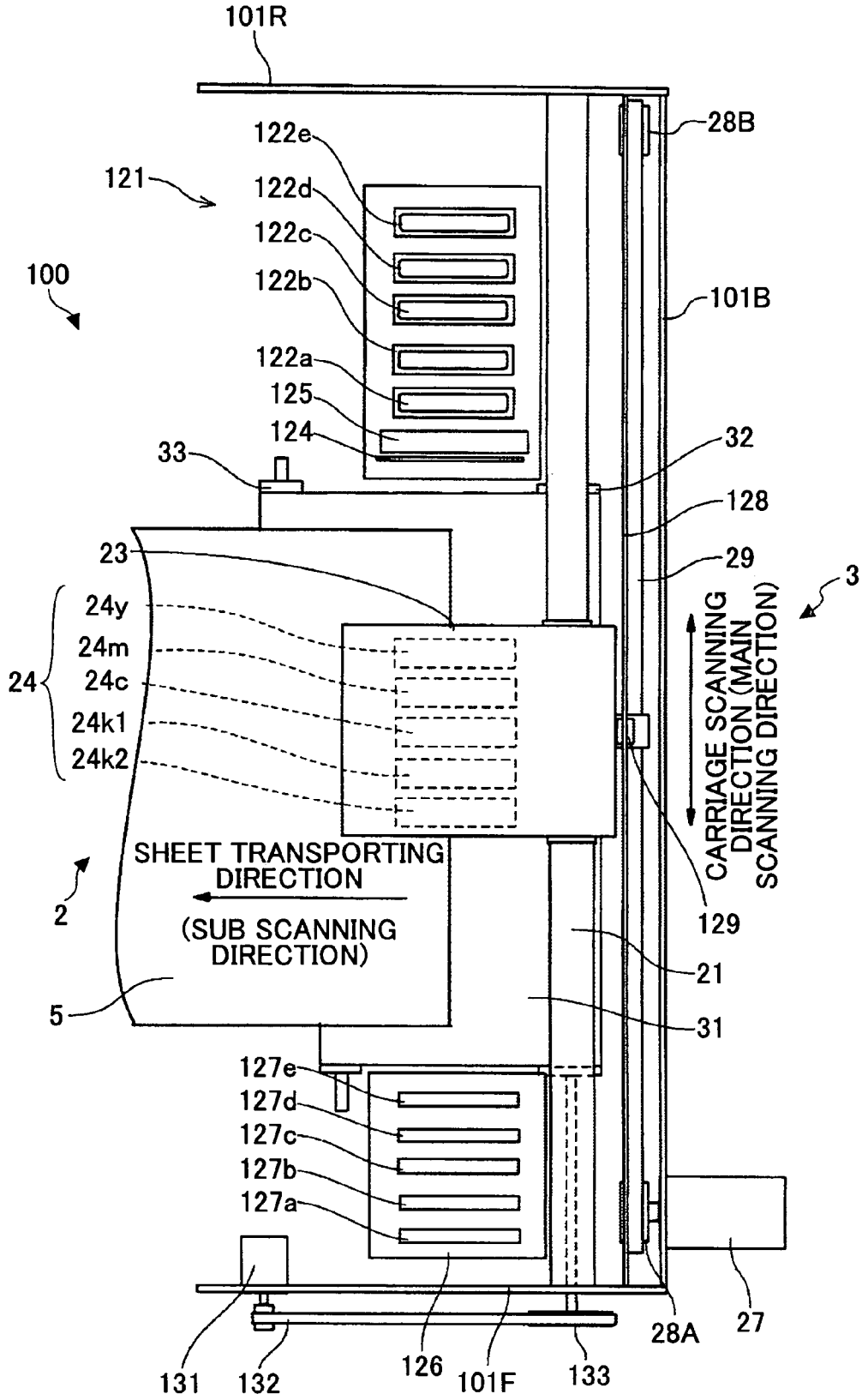
FIG. 2 is a plan view of an engine unit in the image forming apparatus shown in FIG. 1.
Figure 3:
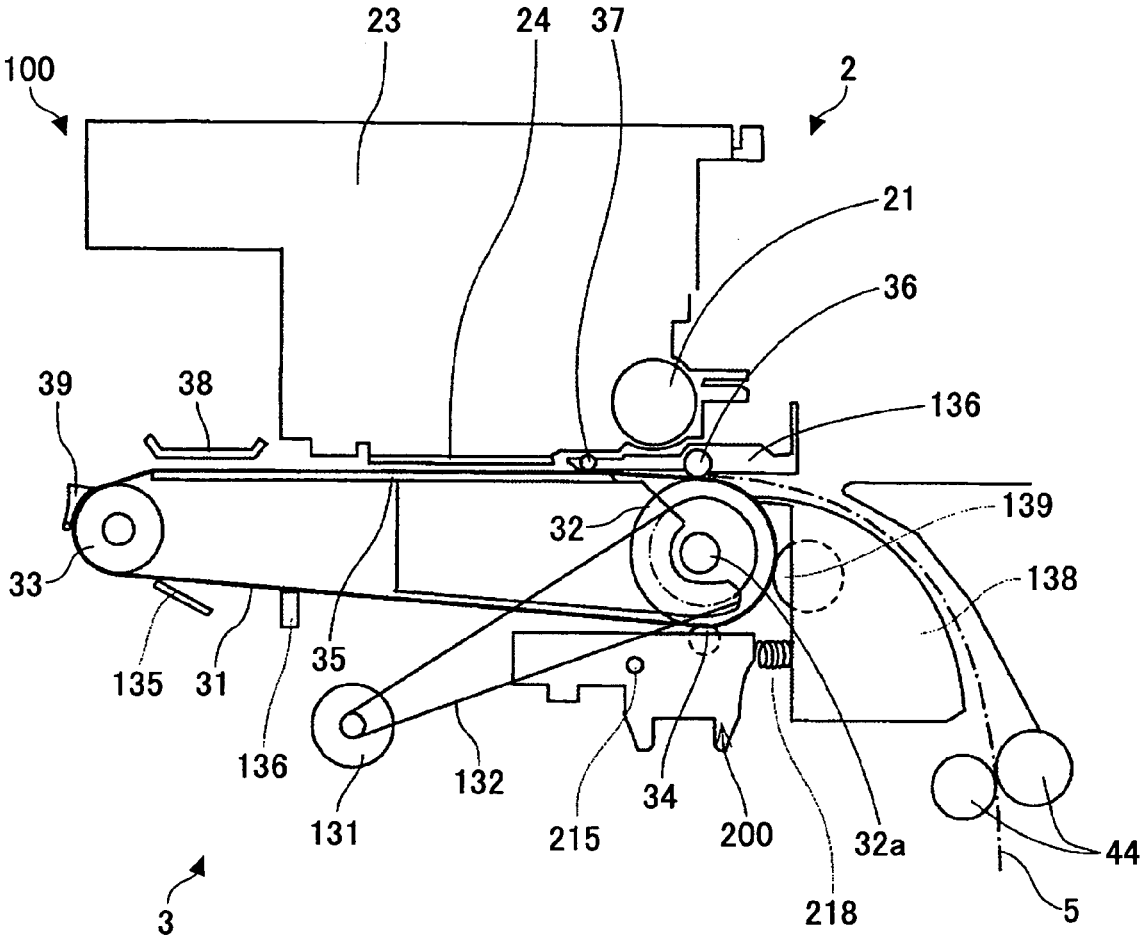
FIG. 3 is a cut-away side view of the engine unit in the image forming apparatus shown in FIG. 1.

First, referring to FIGS. 1 through 3, an image forming apparatus including a sheet transport device according to a first embodiment of the present invention is described. FIG. 1 is a schematic diagram showing a structure of the image forming apparatus according to the first embodiment of the present invention. FIG. 2 is a plan view of an engine unit in the image forming apparatus shown in FIG. 1. FIG. 3 is a cut-away side view of the engine unit in the image forming apparatus shown in FIG. 1.

The image forming apparatus includes an image forming section 2 (image forming unit) which forms an image on a sheet (recording medium) and a sub scanning direction sheet transport section 3 (sheet transport device) in an apparatus main body 1. In the image forming apparatus, each sheet 5 is fed from a sheet feeding section 4 which stores sheets disposed on the bottom face of the apparatus main body 1. The sheet 5 is intermittently transported by the sub scanning direction sheet transport section 3 to a position facing the image forming section 2, and an image is formed (recorded) on the sheet 5 by ejecting liquid droplets on the sheet 5 by the image forming section 2. The sheet 5 on which the image is formed is output on a sheet outputting tray 7 disposed at an upper part of the apparatus main body 1 via a sheet outputting section 6. An engine unit 100 is formed of the image forming section 2 and the sub scanning direction sheet transport section 3, and the engine unit 100 is detachably attached to the apparatus main body 1.

In addition, as an image data (printing data) inputting system for forming an image by the image forming section 2, the image forming apparatus includes an image reading section 11 (scanner) for reading an image above the sheet outputting tray 7 in the apparatus main body 1. In the image reading section 11, an image of a manuscript placed on a contact glass 12 is read by moving a first scanning optical system 15 including a light source 13 and a mirror 14 and a second scanning optical system 18 including mirrors 16 and 17. The scanned (read) manuscript image is read as image signals by an image reading element 20 disposed behind a lens 19. The read image signals are digitized, the digitized signals are processed, and the processed signals are printed as an image. In addition, a thick plate 10 is disposed on the contact glass 12 so as to push the manuscript onto the contact glass 12.

As shown in FIG. 2, the image forming section 2 of the image forming apparatus holds a carriage 23 movable in the main scanning direction by a guide rod 21 (carriage guide) held between a front plate 101F and a rear plate 101R and a guide stay (not shown) disposed at a back stay 101B. The image forming section 2 scans the sheet 5 by moving the carriage 23 in the main scanning direction via a timing belt 29 that is wound around a driving pulley 28A and a driven pulley 28B by the drive of a main scanning direction motor 27.

A recording head 24 composed of liquid droplet ejecting heads each of which ejects a different color liquid droplet is installed on the carriage 23. The recording head 24 is composed of two liquid droplet ejecting heads 24*k*1 and 24*k*2 that eject black ink (K), a liquid droplet ejecting head 24*c* that ejects cyan ink (C), a liquid droplet ejecting head 24*m* that ejects magenta ink (M), and a liquid droplet ejecting head 24*y* that ejects yellow ink (Y). In this description, when color is not referred to, the recording head 24 is used to represent the five liquid droplet ejecting heads. An image is formed on the sheet 5 by moving the carriage 23 in the main scanning direction and transporting the sheet 5 in the sheet transporting direction (sub scanning direction) by the sub scanning direction sheet transport section 3 while causing the recording head 24 to eject liquid droplets. That is, the image forming apparatus is a shuttle type. Each color ink is supplied from a corresponding sub tank 25 (FIG. 1) installed in the carriage 23 for the corresponding liquid droplet ejecting head 24*k*1 through 24*y*. As shown in FIG. 1, ink cartridges 26 that are recording liquid cartridges in which corresponding black, cyan, magenta, and yellow ink is contained are removably attached to a cartridge storing section 26A from the front of the apparatus main body 1. Color ink (recording liquid) is supplied to the corresponding sub tank 25 for each color from the corresponding ink cartridge 26 via a tube (not shown). In the image forming apparatus, the black ink is supplied to two sub tanks 25 from one ink cartridge 26.

In the recording head 24, as a pressure generator (actuator) that applies pressure to ink in an ink flowing route (pressure generating chamber), there are a piezoelectric type pressure generator, a thermal type pressure generator, an electrostatic type pressure generator, and so on. In the piezoelectric type pressure generator, liquid droplets are ejected by changing the volume of the ink flowing route with the deformation of vibration plates by which the walls of the ink flowing route are in part formed by using a piezoelectric element. In the thermal type pressure generator, the liquid droplets are ejected by the pressure of bubbles generated by heating the ink in the ink flowing route by using a heating resistor. In the electrostatic type pressure generator, vibration plates by which the walls of the ink flowing route are in part formed are positioned to face electrodes, and the liquid droplets are ejected by changing the volume of the ink flowing route with deformation of the vibration plates by an electrostatic force generated between the vibration plates and the electrodes. Any one of them can be used in the embodiments of the present invention.

In addition, as shown in FIG. 2, a linear scale 128 having a slit is formed along the main scanning direction of the carriage 23 between the front plate 101F and the rear plate 101R. An encoder sensor 129, disposed in the carriage 23, is a transmission type photo sensor for detecting the slit in the linear scale 128. A linear encoder for detecting movement of the carriage 23 is formed of the linear scale 128 and the encoder sensor 129.

In addition, as shown in FIG. 2, a nozzle maintaining and recovering mechanism (unit) 121 is disposed in a non-printing region located at one side in the scanning direction of the carriage 23 in the apparatus main body 1. The nozzle maintaining and recovering mechanism 121 maintains normal conditions of nozzles of the recording head 24 and recovers from abnormal conditions of the recording head 24. The nozzle maintaining and recovering mechanism 121 includes a suction cap 122*a* which also works as a humidity keeping cap, four humidity keeping caps 122*b* through 122*e* for capping nozzle surfaces of the recording head 24, a wiper blade 124 for wiping the nozzle surfaces of the recording head 24, and a remaining recording liquid receiving member 125 for receiving recording liquid which does not contribute to forming an image.

In this description, when color is not referred to, a humidity keeping cap 122 is used to represent the five humidity keeping caps.

Further, as shown in FIG. 2, in a non-printing region located at the other side in the scanning direction of the carriage 23 in the apparatus main body 1, a remaining recording liquid receiving member 126 is disposed for receiving recording liquid which does not contribute to forming an image from the five recording heads 24. The remaining recording liquid receiving member 126 includes five openings 127*a* through 127*e* for the five recording heads 24.

As shown in FIGS. 1 and 3, the sub scanning direction sheet transport section 3 (sheet transport device) includes a transporting roller 32 which is a driving roller, a driven roller 33 which is a tension roller, a transport belt 31, a charging roller 34, a platen guiding member 35, a first pushing roller 36, a second pushing roller 37, a sheet pushing member 38, and a sheet separating claw 39. The transporting roller 32 transports the sheet 5 fed from the sheet feeding section 4 by changing the transporting direction by approximately 90 degrees for the sheet 5 to face the image forming section 2 while the sheet 5 is held by an electrostatic force. The transport belt 31 is an endless belt which is wound around the transporting roller 32 and the driven roller 33. The charging roller 34 applies a high alternating voltage (AC bias voltage) to the transport belt 31 so that the surface of the transport belt 31 is charged. The platen guiding member 35 guides the transport belt 31 at the region facing the image forming section 2. The first pushing roller 36 pushes the sheet 5 onto the transport belt 31 at the position facing the transporting roller 32. The second pushing roller 37 pushes the sheet 5 onto the transport belt 31 at the position facing the platen guiding member 35 between the recording head 24 and the transporting roller 32. The sheet pushing member 38 pushes the sheet 5 having an image formed by the image forming section 2 onto the transport belt 31. The sheet separating claw 39 separates the sheet 5 having the formed image from the transport belt 31.

The transporting roller 32 is rotated by a sub scanning direction motor 131 via a timing belt 132 and a timing roller 133 (FIG. 2); with this, the transport belt 31 of the sub scanning direction sheet transport section 3 is rotatably moved in the sheet transporting direction (sub scanning direction). In addition, the sub scanning direction sheet transport section 3 includes a cleaning member 135 for removing paper powders on the transport belt 31 and a discharging member 136 for discharging electric charges on the surface of the transport belt 31.

The sheet feeding section 4 is detachable from the apparatus main body 1 and includes sheet feeding cassettes 41 in each of which many sheets 5 are stored; a sheet feeding roller 42 and a friction pad 43 that feed the sheets 5 by picking up each sheet 5 from the sheet feeding cassette 41; and a pair of registration rollers 44 that executes registration of the fed sheet 5.

In addition, the sheet feeding section 4 includes a manual sheet feeding tray 46 in which many sheets 5 are stored, a sheet feeding roller 47 that feeds the sheets 5 by picking up each sheet 5 from the manual sheet feeding tray 46, and a sheet vertical transporting roller 48 that transports the sheet 5 fed from another sheet feeding cassette (not shown), which is installed under the apparatus main body 1 as an option, and from a duplex print unit (not shown). Rollers such as the sheet feeding roller 42, the registration rollers 44, the sheet feeding roller 47, and the sheet vertical transporting roller 48, which feed the sheet 5 to the sub scanning direction sheet transport section 3, are rotatably driven by a sheet feeding motor 49, which is an HD type stepping motor, via an electromagnetic clutch (not shown).

The sheet outputting section 6 includes three pairs of sheet outputting rollers 61, 62, and 63 for transporting a sheet 5 having an image formed by the image forming section 2, and two pairs of sheet outputting rollers 64 and 65 for outputting the sheet 5 to the sheet outputting tray 7.

[Charging Unit]

Figure 4:
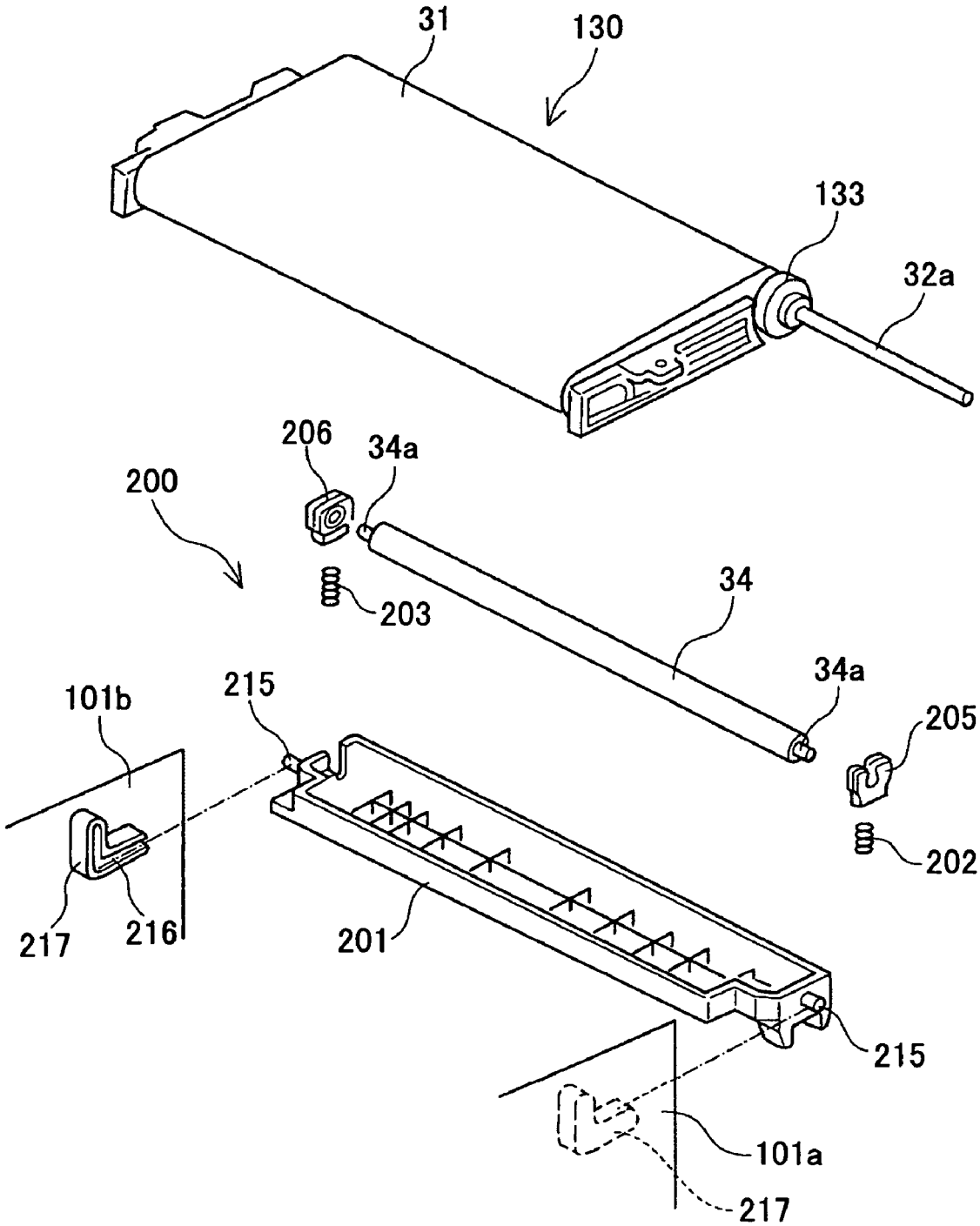
FIG. 4 is an exploded perspective view of a charging unit and a transport belt unit according to the first embodiment of the present invention.

Next, referring to FIGS. 3 and 4, a charging unit is described. The charging unit is included in the sub scanning direction sheet transport section 3 (sheet transport device) in the image forming apparatus. FIG. 4 is an exploded perspective view of a charging unit 200 and a transport belt unit 130 according to the first embodiment of the present invention.

As shown in FIG. 4, the charging unit 200 includes the charging roller 34 (charging member) and springs 202 and 203 (pressure applying unit) which push the charging roller 34 onto the transport belt 31 in a unit case 201. Charging the charging roller 34 is described below.

Both ends 34*a* of the charging roller 34 are rotatably held by corresponding holding members 205 and 206. The holding members 205 and 206 are pushed toward the transport belt 31 by the springs 202 and 203 disposed between the unit case 201 and the holding members 205 and 206, and the charging roller 34 is pushed onto the transport belt 31.

Positioning pins 215 are formed at both ends of the unit case 201. Guiding members 217 having corresponding guide grooves 216 are formed in corresponding sub side plates 101*a* and 101*b* which hold the transport belt unit 130 so as to guide the corresponding positioning pins 215. The guide grooves 216 guide the corresponding positioning pins 215 so that the charging roller 34 is pushed onto the transport belt 31.

In addition, at the position where the sheet 5 is input to the sub scanning direction sheet transport section 3, a transport guiding member 138 (FIG. 3) is formed for guiding the sheet 5 transported from the registration rollers 44 to the transport belt 31. The unit case 201 of the charging unit 200 is pushed in the direction that the charging roller 34 is pushed onto the transport belt 31 by a spring 218 (FIG. 3) disposed between the transport guiding member 138 and the unit case 201.

In addition, a pressure applying roller 139 is held by the transport guiding member 138 so that the transport belt 31 is pushed onto the transport roller 32. The sub side plates 101*a* and 101*b* are disposed by being sandwiched between the front plate 101F and the rear plate 101R (FIG. 2).

[Controller of Image Forming Apparatus]

Figure 5:
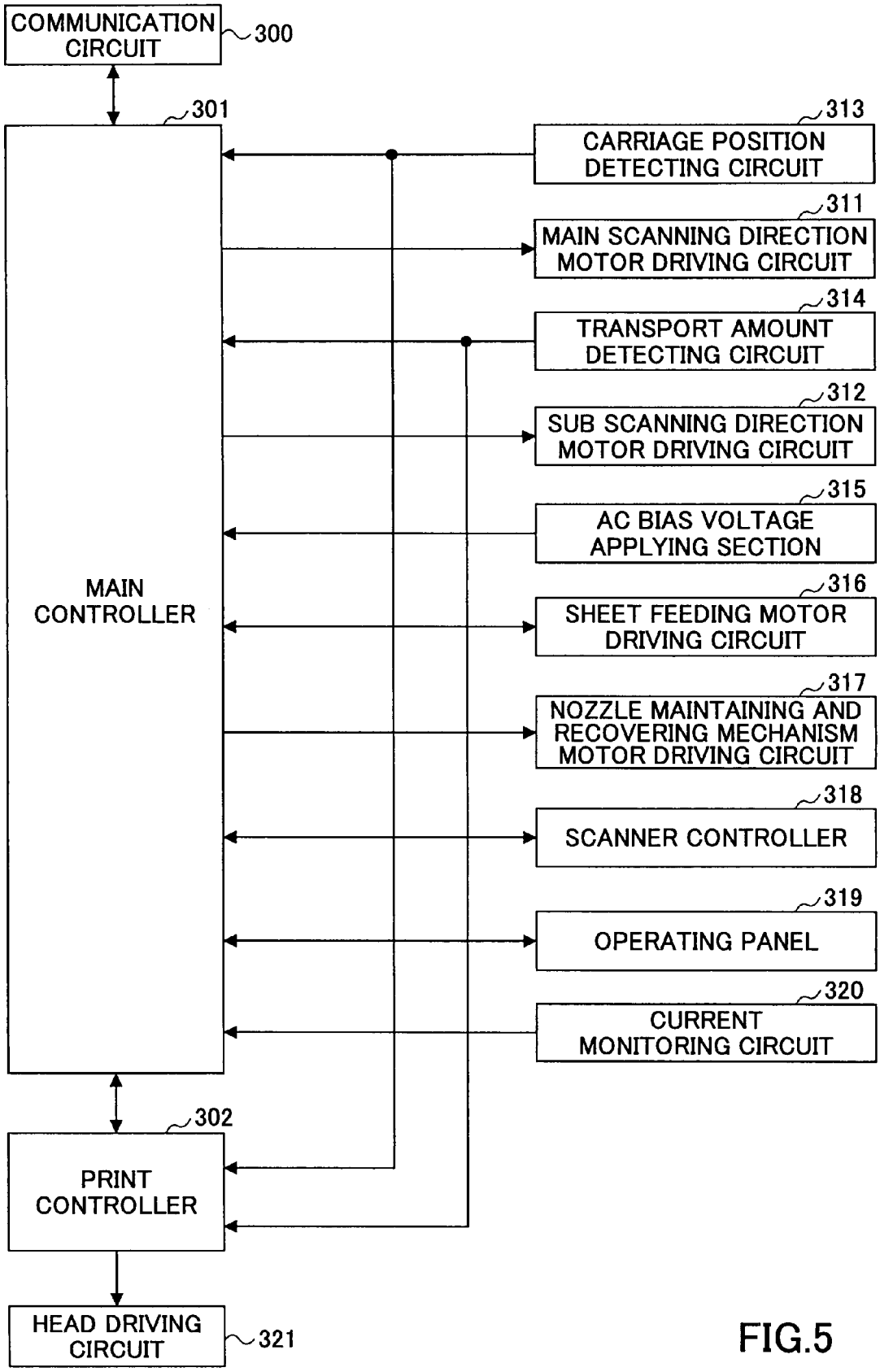
FIG. 5 is a block diagram showing a controller of the image forming apparatus according to the first embodiment of the present invention.

Next, referring to FIG. 5, a controller of the image forming apparatus is described. FIG. 5 is a block diagram showing the controller of the image forming apparatus according to the first embodiment of the present invention.

The controller controls all operations (elements) of the image forming apparatus and includes a main controller 301 and a print controller 302. The main controller 301 is a microcomputer including a CPU, a ROM, a RAM, a VRAM, interfaces (I/Os), and so on. The print controller 302 is a microcomputer for controlling printing operations (elements). The sheet transport device 3 (sub scanning direction sheet transport section) also includes a part of the elements (operations) in the controller shown in FIG. 5.

The main controller 301 controls (drives) a main scanning direction motor driving circuit 311 for driving the main scanning direction motor 27 and a sub scanning direction motor driving circuit 312 for driving the sub scanning direction motor 131 so that an image is formed on the sheet 5 based on print processing information input from a communication circuit 300. In addition, the main controller 301 inputs print data to the print controller 302.

A detection signal is input to the main controller 301 which signal is a positional signal of the carriage 23 detected by a carriage position detecting circuit 313, and the main controller 301 controls the moving speed and the moving position of the carriage 23 based on the detection signal. The carriage position detecting circuit 313 detects the position of the carriage 23 by counting (reading) the number of slits of the linear scale (encoder sheet) 128 (FIG. 2) disposed in the scanning direction of the carriage 23 by using the photo-sensor (encoder sensor) 129 (FIG. 2) disposed on the carriage 23. The main scanning direction motor driving circuit 311 rotates (drives) the main scanning direction motor 27 corresponding to a carriage moving value output from the main controller 301 and moves the carriage 23 to a predetermined position at a predetermined speed. The carriage moving value is, for example, a PWM value when PWM control is executed.

In addition, a detection signal is input to the main controller 301 which signal is a moving amount signal of the transport belt 31 detected by a transport amount detecting circuit 314, and the main controller 301 controls the moving speed and the moving position of the transport belt 31 based on the detection signal. The transport amount detecting circuit 314 detects the transport amount of the transport belt 31 by counting (reading) the number of slits of an encoder wheel (not shown) attached to the axle 32*a* of the transporting roller 32 by using the encoder sensor 129. The sub scanning direction motor driving circuit 312 rotates (drives) the sub scanning direction motor 131 corresponding to a transport value output from the main controller 301 and moves the transport belt 31 to a predetermined position at a predetermined speed by rotating the transporting roller 32.

The main controller 301 controls the transport belt 31 to be charged by applying an AC bias voltage to the charging roller 34 via an AC bias voltage applying section 315. The main controller 301 rotates (drives) the sheet feeding motor 49 via a sheet feeding motor driving circuit 316. The main controller 301 rotates (drives) a motor (not shown) of the nozzle maintaining and recovering mechanism 121 via a nozzle maintaining and recovering mechanism motor driving circuit 317. By the rotation of the motor, the cap 122 rises and falls, the wiper blade 124 rises and falls, and a suction pump (not shown) moves.

The main controller 301 controls the image reading section 11 via a scanner controller 318. The main controller 301 makes an operating panel 319 display necessary information and obtains information input on the operating panel 319.

The main controller 301 obtains a monitor signal from a current monitoring circuit 320 which monitors a leakage current from the AC bias voltage applying section 315 when the transport belt 31 is charged by the charging roller 34 via the AC bias voltage applying section 315. When the charging roller 34 needs cleaning based on the monitor signal, a message for requesting the cleaning of the charging roller 34 is displayed on the operating panel 319.

The print controller 302 forms image data for driving a pressure generating unit (not shown) which makes the recording head 24 eject liquid droplets on the sheet 5 based on a signal from the main controller 301, the position of the carriage 23 detected from the carriage position detecting circuit 313, the transport amount of the transport belt 31 detected from the transport amount detecting circuit 314, and so on. The print controller 302 transfers image data to a head driving circuit 321 as serial data, and also outputs a transfer clock and a clutch signal which are needed to transfer and determine the image data and a liquid droplet control signal (mask signal) to the head driving circuit 321. In addition, the print controller 302 includes a DAC (digital to analog converter) (not shown) which converts pattern data of a driving signal stored in a ROM into analog data, a driving waveform generating section (not shown) including a voltage amplifier and a current amplifier, and a driving waveform selecting unit (not shown) which outputs a driving waveform to a head driver (not shown). The print controller 302 forms a driving waveform consisting of one driving pulse (driving signal) or plural driving pulses and outputs the driving waveform to the head driving circuit 321.

The head driving circuit 321 drives the recording head 24 by applying a driving signal to a driving element (for example, a piezoelectric element) which selectively generates energy for making the recording head 24 eject liquid droplets. The driving signal includes the driving waveform given from the print controller 302 based on the image data of one line of the recording head 24 input as serial data. At this time, by selecting a driving pulse in the driving waveform, dots having different sizes can be ejected. For example, a large droplet (large dot), a medium droplet (medium dot), and a small droplet (small dot) can be ejected.

Figure 6:
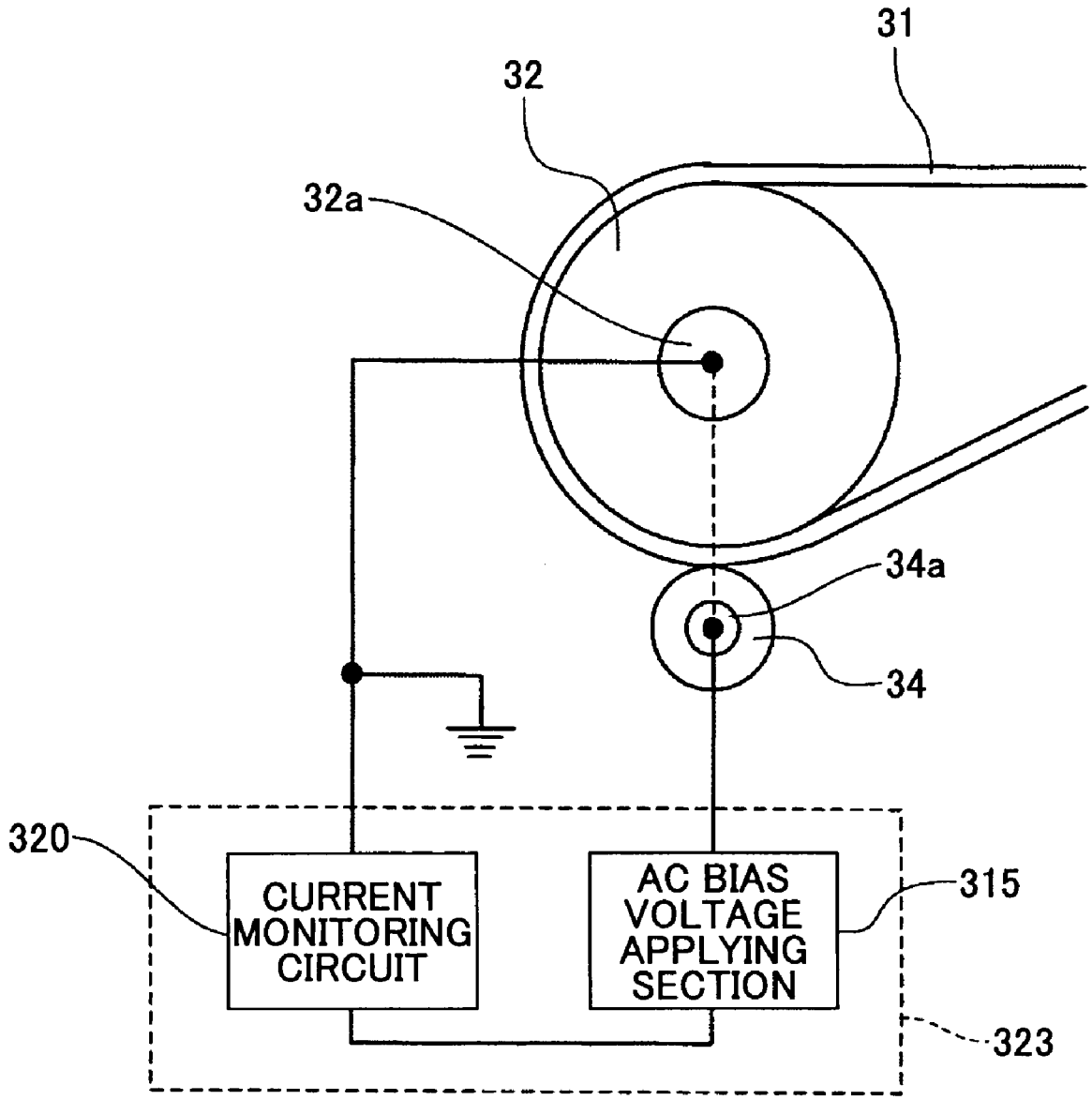
FIG. 6 is a diagram showing a leakage current detecting unit shown in FIG. 5.

Next, referring to FIG. 6, a leakage current detecting unit is described. The leakage current detecting unit detects a leakage current when the charging roller 34 charges the transport belt 31. FIG. 6 is a diagram showing the leakage current detecting unit.

The AC bias voltage applying section 315 applies an AC high voltage (AC high voltage) to the axle 34*a* (both ends) of the charging roller 34. The current monitoring circuit 320 monitors a current which flows in a closed circuit formed of the AC bias voltage applying section 315, the charging roller 34, the transport belt 31, and the transporting roller 32, when the AC bias voltage applying section 315 applies the AC bias voltage to the charging roller 34. A high voltage power source 323 is formed of the AC bias voltage applying section 315 and the current monitoring circuit 320.

When a leakage current is generated in the closed circuit, since a current value in the closed circuit is increased, the current monitoring circuit 320 outputs a leakage detection signal. For example, when recording liquid (ink) is adhered onto the transport belt 31, impedance at the part where the ink is adhered is lowered and a current flowing in the closed circuit is increased, or when a damaged part exists on the surface of the transport belt 31, impedance at the damaged part is lowered and a current flowing in the closed circuit is increased. In addition, when paper powder is adhered onto the surface of the transport belt 31, a current flowing into the closed circuit may be increased.

The current monitoring circuit 320 is formed to be able to detect a current of positive and negative polarity by using a transistor, a resistor, a PWM IC, and so on. That is, an AC high voltage (or pulse voltages of positive and negative polarity) is applied to the transport belt 31 via the charging roller 34, and electric charges of positive polarity and negative polarity are alternately applied onto the surface of the transport belt 31 in the moving direction of the transport belt 31. With this, stable adherence of the sheet 5 onto the transport belt 31 can be obtained.

In a case where a leakage current is detected by applying an AC high voltage onto the transport belt 31, when the leakage current is detected by only one of the positive polarity and the negative polarity, detection of the leakage current may be missed. In order to avoid the above, the leakage current is surely detected by using both the positive polarity and the negative polarity.

In an image forming apparatus, a rotated amount of the transporting roller 32 which drives the transport belt 31 is detected, the sub scanning direction motor 131 is driven corresponding to the detected rotated amount of the transporting roller 32, and a high alternating voltage having positive polarity and negative polarity is applied to the charging roller 34 from the AC bias voltage applying section 315. With this, positive electric charges and negative electric charges are alternately applied onto the surface of the transport belt 31 at predetermined widths with belt shapes along the transporting direction, and a non-uniform electric field is formed on the surface of the transport belt 31 due to its being charged.

The sheet 5 is transported at the position between the transporting roller 32 and the first pushing roller 36 from the sheet feeding section 4, and is transported onto the transport belt 31 where the non-uniform electric field is formed. The sheet 5 is transported by the movement of the transport belt 31 by being attached onto the transport belt 31 by an electrostatic attraction force.

While the sheet 5 is intermittently transported by the transport belt 31, liquid droplets of recoding liquid are ejected from the recording head 24 onto the sheet 5, and an image is formed on the sheet 5. The tip of the sheet 5 on which the image is formed is separated from the transport belt 31 by the sheet separating claw 39 and the sheet 5 is output to the sheet outputting section 6.

In a print standby mode, the carriage 23 is moved to the side of the nozzle maintaining and recovering mechanism 121, the nozzle surface of the recording head 24 is capped by the cap 122 and is maintained in the humidity keeping condition and defective ejection of liquid droplets caused by the recording liquid drying is prevented. In addition, while the nozzle surface of the recording head 24 is capped by the suction cap 122*a* which also works as the humidity keeping cap, the remaining recording liquid is suctioned from the nozzles of the recording head 24; with this, recovering operations of the nozzle surface of the recording head 24 are executed so that high viscosity recording liquid and bubbles are output. Further, the wiper blade 124 wipes the nozzle surface of the recording head 24 for removing the recording liquid on the nozzle surface of the recording head 24 adhered by the recovering operations. In addition, before starting the print process or during the print process, recording liquid not being used for the printing process is ejected to the remaining recording liquid receiving member 125. With this, ejecting performance of the recording liquid from the recording head 24 can be stably maintained.

In the image forming apparatus, since the charging roller 34 which charges the transport belt 31 always contacts the transport belt 31, when recording liquid and/or dew condensation water is adhered onto the surface of the transport belt 31, the recording liquid and/or the water is transferred onto the charging roller 34 when the transport belt 31 is rotated. Consequently, the resistance value of the charging roller 34 is lowered, and the current value from the AC bias voltage applying section 315 is increased (due to the constant voltage control). When the current value exceeds a predetermined value, a leakage current is detected.

When a leakage detection signal is input to the main controller 301 from the current monitoring circuit 320, the main controller 301 displays, for example, a message to clean the charging roller 34, on the operating panel 319.

As described above, since the image forming apparatus includes the charging unit 200 having the charging roller 34, when the charging unit 200 is detached from the apparatus main body 1, the recording liquid and/or the water can be easily removed from the charging roller 34. That is, the charging unit 200 can be attached to the apparatus main body 1 and detached from the apparatus main body 1 as one unit. Therefore, the charging roller 34 can be returned to the normal operating conditions.

As described above, the sheet transport device 3 includes the transport belt 31 which transports the sheet 5 with an electrostatic force by adhering the sheet 5 onto the surface of the transport belt 31 and the charging unit 200 which includes the charging roller 34 for charging the transport belt 31. Therefore, when the charging unit 200 is detached from the apparatus main body 1, the charging roller 34 can be easily cleaned.

In this case, since the charging unit 200 includes the charging roller 34 and the pressure applying unit (springs 202 and 203) which pushes the charging roller 34 onto the transport belt 31, the charging unit 200 includes the necessity minimum elements and can be easily detached from the apparatus main body 1, and the exchanging efficiency of the charging unit 200 and cleaning efficiency of the charging roller 34 can be increased.

Second Embodiment

Figure 7:
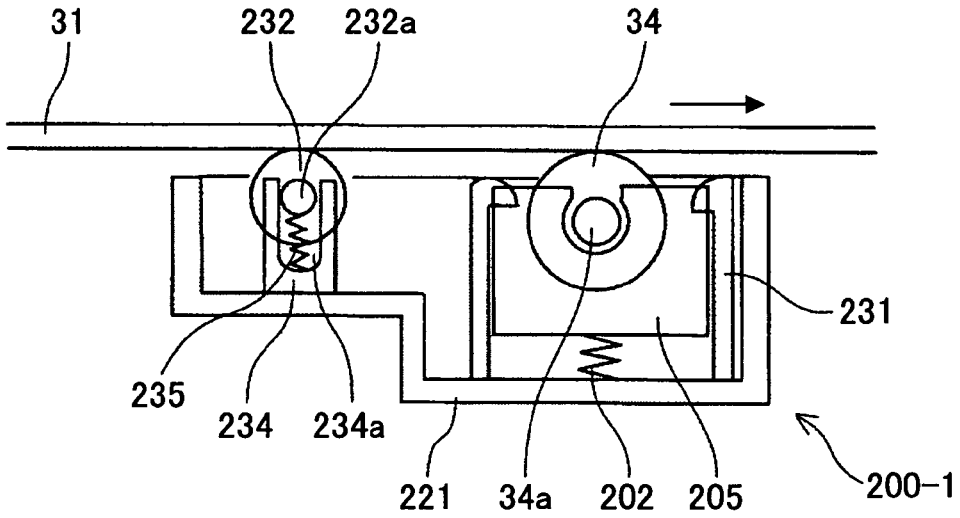
FIG. 7 is a schematic diagram showing a charging unit according to a second embodiment of the present invention.

Next, referring to FIG. 7, a second embodiment of the present invention is described. FIG. 7 is a schematic diagram showing a charging unit 200-1 according to the second embodiment of the present invention.

As shown in FIG. 7, in a unit case 221 of the charging unit 200-1, the charging roller 34 is held by a charging roller holder 231, and a cleaning roller 232 (cleaning unit) for cleaning the surface of the transport belt 31 is held by a holder 234 at an upstream side in the transport belt moving direction (the arrow direction). In FIG. 7, the end 34*a* of the charging roller 34, the holding member 205, and the spring 202 at the right side shown in FIG. 4 are shown.

An axle 232*a* of the cleaning roller 232 is inserted into a groove 234*a* of the holder 234 movable in the vertical direction. The cleaning roller 232 is pushed onto the transport belt 31 by a spring 235. The cleaning roller 232 can be formed of a urethane foam material having a water absorbing property. It is preferable that the material be a single foam material or a continuous foam material having a water absorbing property.

When recording liquid and/or water is adhered onto the surface of the transport belt 31, the cleaning roller 232 absorbs (removes) the recording liquid and/or the water. Therefore, transferring the recording liquid and/or the water onto the charging roller 34 from the surface of the transport belt 31 can be reduced, and the leakage currents can be reduced.

Third Embodiment

Figure 8:
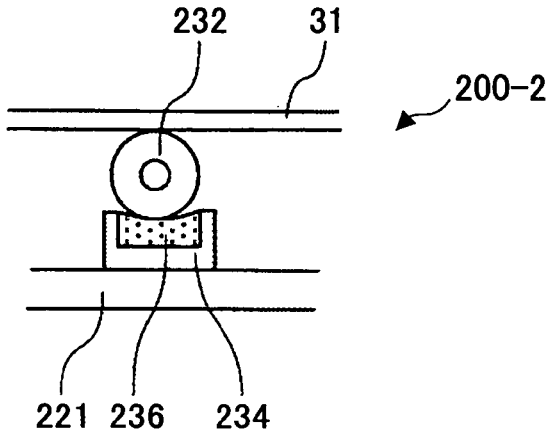
FIG. 8 is a schematic diagram showing a part of a charging unit according to a third embodiment of the present invention.

Next, referring to FIG. 8, a third embodiment of the present invention is described. FIG. 8 is a schematic diagram showing a part of a charging unit 200-2 according to the third embodiment of the present invention.

As shown in FIG. 8, the holder 234 is disposed on the unit case 221 of the charging unit 200-2, and a cleaning member 236 is disposed in the holder 234. The cleaning member 236 cleans the surface of the cleaning roller 232 by contacting the surface of the cleaning roller 232.

When the cleaning member 236 is disposed, the cleaning member 236 can absorb (remove) recording liquid and/or water on the surface of cleaning roller 232. With this, the effect of the cleaning roller 232 can be continued, and even if recording liquid and/or water is continuously adhered onto the transport belt 31, transferring the recording liquid and/or the water onto the charging roller 34 from the transport belt 31 can be reduced.

Fourth Embodiment

Figure 9:
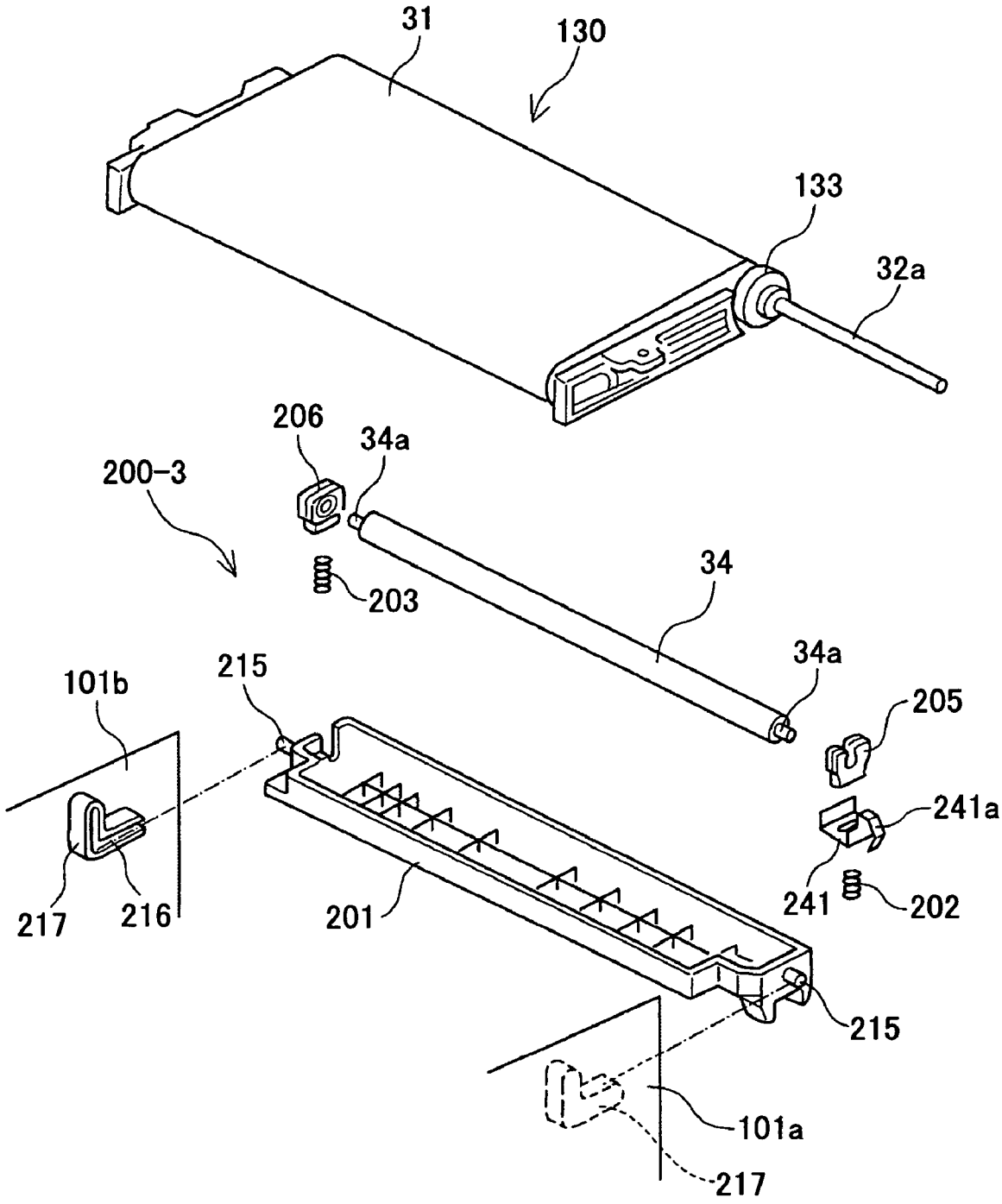
FIG. 9 is an exploded perspective view of a charging unit and the transport belt unit according to a fourth embodiment of the present invention.
Figure 10:
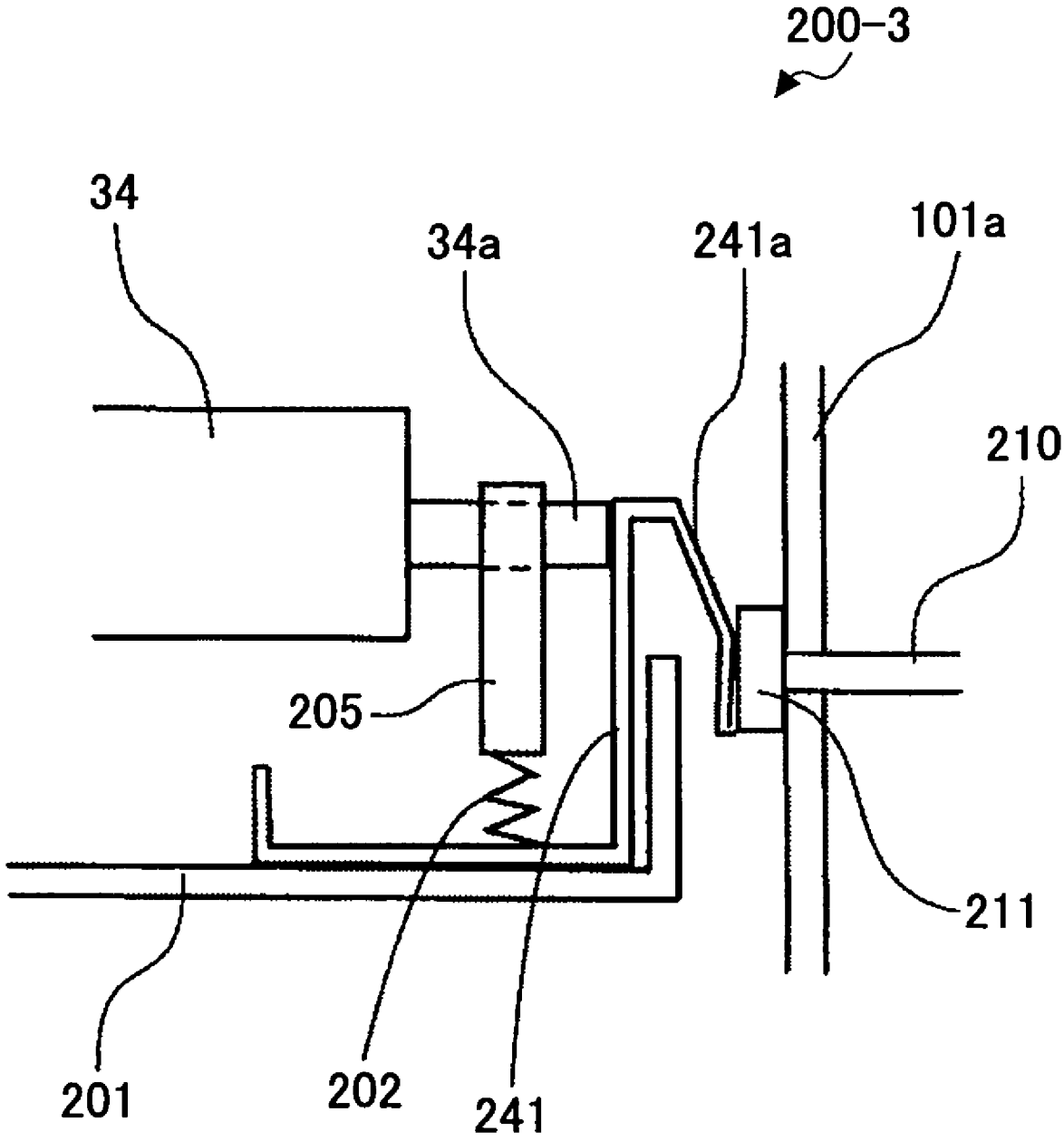
FIG. 10 is a schematic diagram showing one side of a main part of the charging unit shown in FIG. 9.

Next, referring to FIGS. 9 and 10, a fourth embodiment of the present invention is described. FIG. 9 is an exploded perspective view of a charging unit 200-3 and the transport belt unit 130 according to the fourth embodiment of the present invention. FIG. 10 is a schematic diagram showing one side of a main part of the charging unit 200-3 shown in FIG. 9.

As shown in FIGS. 9 and 10, in the charging unit 200-3, an electrode member 241 is attached to the unit case 201. The electrode member 241 applies an AC bias voltage (high voltage) to the end 34*a* of the charging roller 34 by contacting the end 34*a*. The electrode member 241 includes a contact 241*a* which is extended to the outside of the unit case 201. In addition, a terminal 211 is disposed on the sub side plate 101*a*, to which terminal a high voltage from the AC bias voltage applying section 315 is applied via a high voltage cable 210.

The end 34*a* of the charging roller 34 contacts the electrode member 241 by being held by the holding member 205 formed of a conductive material and the spring 202 formed of a conductive material which pushes the holding member 205.

When the charging unit 200-3 is attached to the sub side plates 101*a* and 101*b*, the contact 241*a* of the electrode member 241 contacts the terminal 211 of the high voltage cable 210. With this, an AC bias voltage is applied to the end 34*a* of the charging roller 34 via the electrode member 241 and also via the spring 202 and the holding member 205.

When an AC bias voltage from the AC bias voltage applying section 315 is applied to the end 34*a* of the charging roller 34, the electrode member 241 is extended to the outside of the unit case 201. When the unit case 201 is attached to the sub side plates 101*a* and 101*b* holding the transport belt unit 130, the terminal 211 of the AC bias voltage applying section 315 contacts the contact 241*a* of the electrode member 241. The AC bias voltage is applied to the end 34*a* of the charging roller 34 via two voltage applying routes, that is, directly via the electrode member 241 and via the spring 202 and the holding member 205.

In the above, only one side of the charging unit 200-3 is described; however, at the other side of the charging unit 200-3, a similar structure to the one side is formed.

As described above, in the fourth embodiment of the present invention, since the high voltage cable 210 is not connected to the unit case 201, only the unit case 201 need be detached from the apparatus main body 1. Therefore, the operability of the image forming apparatus can be increased.

In FIGS. 9 and 10, the other elements are described in FIG. 4 of the first embodiment of the present invention; therefore, the description of the other elements is omitted.

Fifth Embodiment

Figure 11:
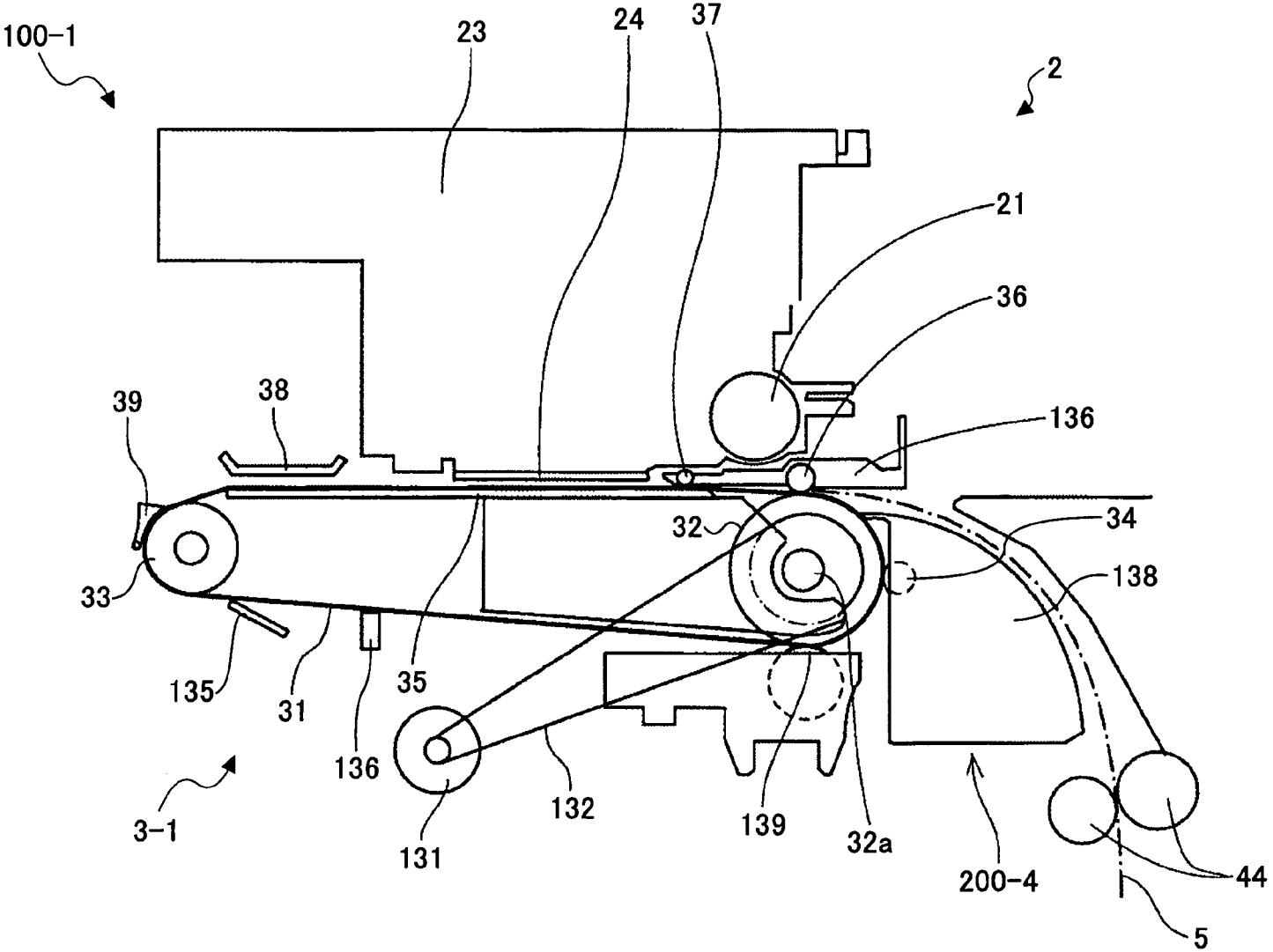
FIG. 11 is a cut-away side view of an engine unit according to a fifth embodiment of the present invention.

Next, referring to FIG. 11, a fifth embodiment of the present invention is described. FIG. 11 is a cut-away side view of an engine unit 100-1 according to the fifth embodiment of the present invention. The engine unit 100-1 includes the image forming section 2 and a sub scanning direction sheet transport section 3-1 (sheet transport device), and the engine unit 100-1 is detachably attached to the apparatus main body 1.

As shown in FIG. 11, the positions of the charging roller 34 and the pressure applying roller 139 are different from those shown in FIG. 3. That is, in a charging unit 200-4, the charging roller 34 is disposed in the transport guiding member 138, and the pressure applying roller 139 is disposed at the position of the charging roller 34 shown in FIG. 3.

That is, the charging unit 200-4 includes the charging roller 34, the pressure applying roller 139, and the transport guide member 138. Therefore, the charging unit 200-4 can be easily detached from the apparatus main body 1 and can be easily cleaned.

In the fourth embodiment of the present invention, for example, the cleaning roller 232, the cleaning member 236 which cleans the surface of the cleaning roller 232 shown in FIG. 8 of the third embodiment can be disposed on the upstream side of the transport belt 31.

Sixth Embodiment

Figure 12:
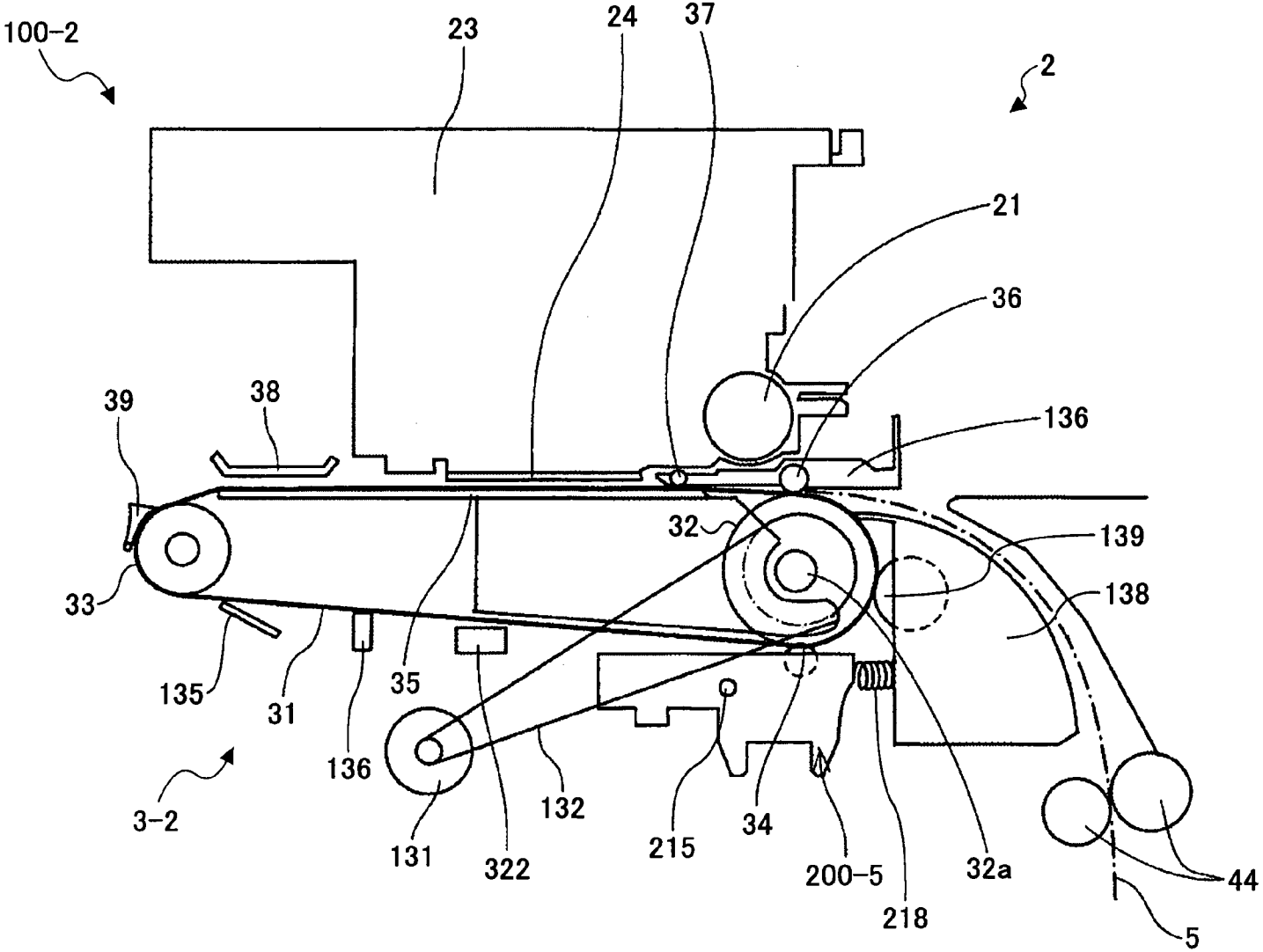
FIG. 12 is a cut-away side view of an engine unit according to a sixth embodiment of the present invention.
Figure 13:
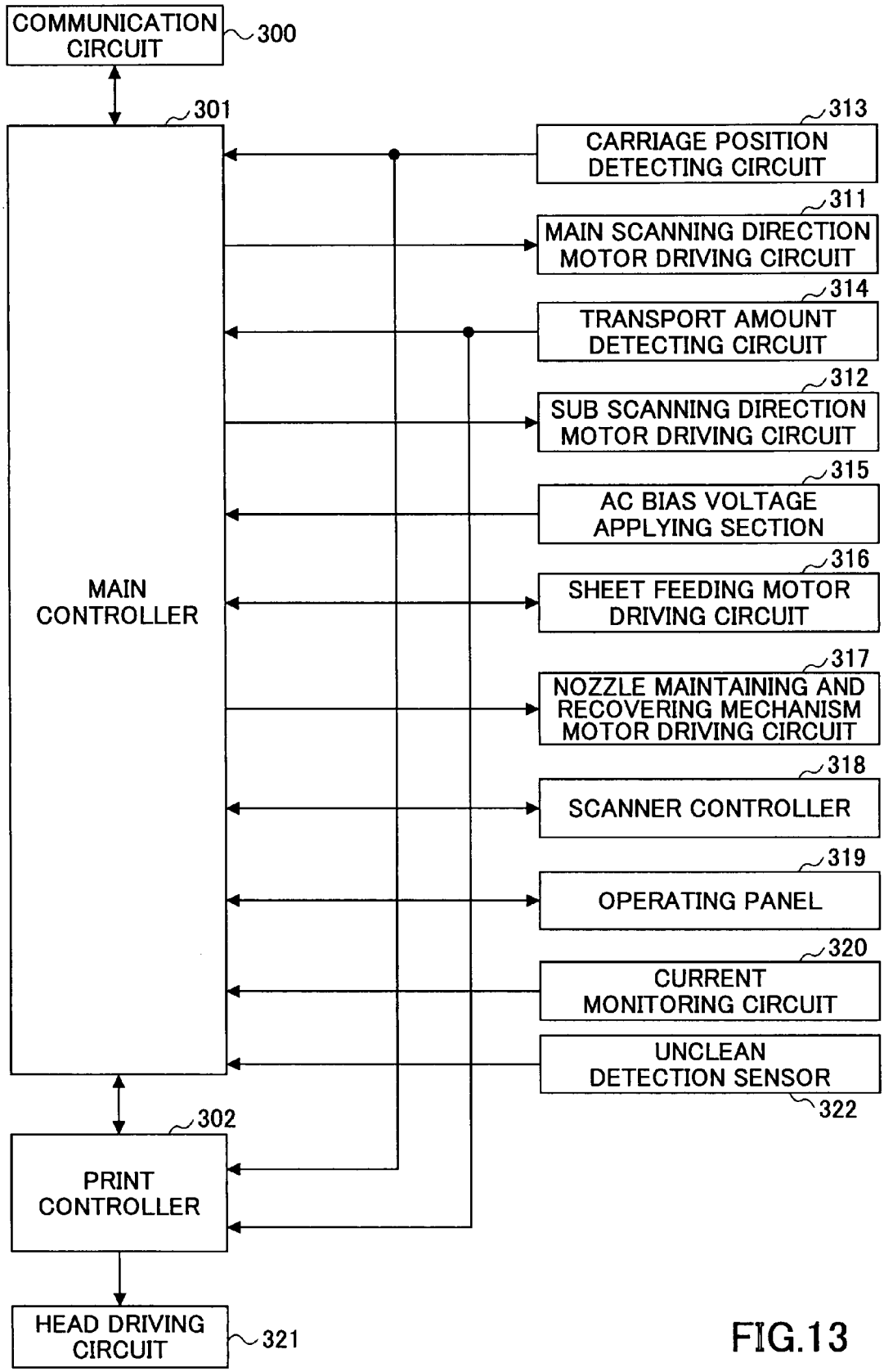
FIG. 13 is a block diagram showing a controller of the image forming apparatus according to the sixth embodiment of the present invention.

Next, referring to FIGS. 12 and 13, a sixth embodiment of the present invention is described. FIG. 12 is a cut-away side view of an engine unit 100-2 according to the sixth embodiment of the present invention. The engine unit 100-2 includes the image forming section 2 and a sub scanning direction sheet transport section 3-2 (sheet transport device), and the engine unit 100-2 is detachably attached to the apparatus main body 1. FIG. 13 is a block diagram showing a controller of the image forming apparatus according to the sixth embodiment of the present invention.

As shown in FIGS. 12 and 13, in the sixth embodiment of the present invention, an unclean detection sensor 322 is added in the controller of the sixth embodiment of the present invention when the controller is compared with the controller in the first embodiment of the present invention shown in FIG. 5. The unclean detection sensor 322 detects uncleanness of the surface of the transport belt 31. As the unclean detection sensor 322, for example, a photo-sensor or a concentration detection sensor can be used. An unclean signal detected by the unclean detection sensor 322 is input to the main controller 301. The main controller 301 determined whether the leakage current detection is caused by a real leakage current or the uncleanness of the surface of the transport belt 31 by combining a signal monitored by the current monitoring circuit 320 with the unclean signal detected by the unclean detection sensor 322. The sheet transport device 3 (sub scanning direction sheet transport section) also includes a part of the elements (operations) in the controller shown in FIG. 13.

Figure 14:
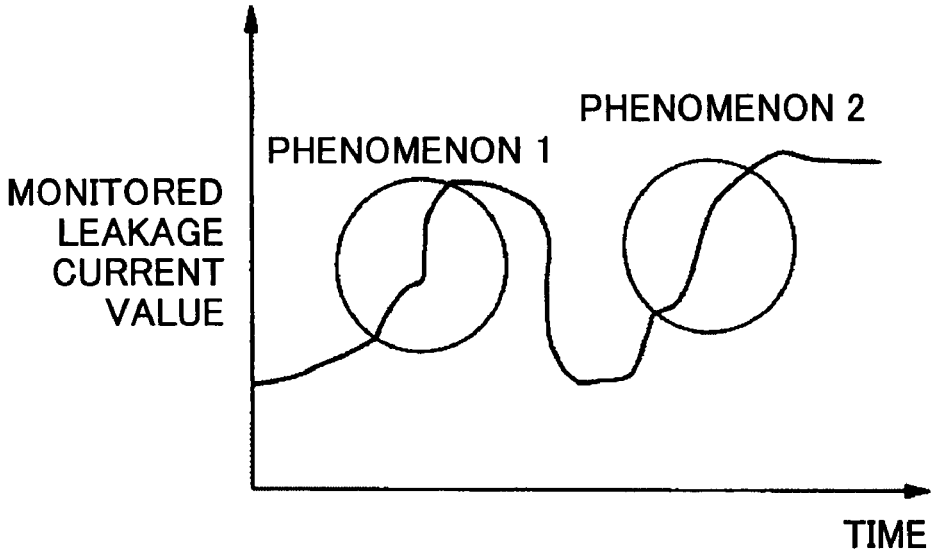
FIG. 14 is a graph showing a leakage current value monitored by a current monitoring circuit shown in FIG. 13 with the passage of time.
Figure 15:
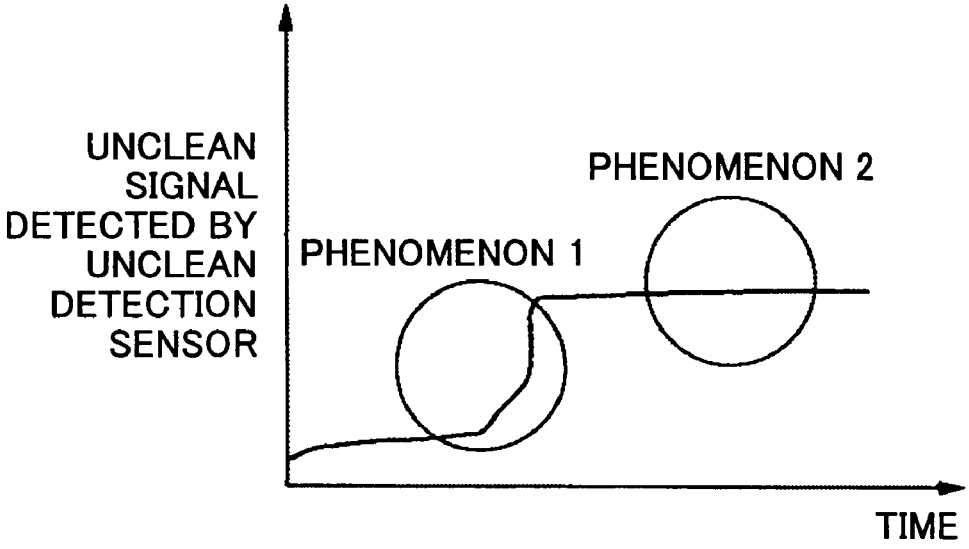
FIG. 15 is a graph showing an unclean signal detected by an unclean detection sensor shown in FIG. 13 with the passage of time.

Referring to FIGS. 14 and 15, the criterion whether the leakage current detection is caused by a real leakage current or the uncleanness of the surface of the transport belt 31 is described. FIG. 14 is a graph showing a leakage current value monitored by the current monitoring circuit 320 with the passage of time. FIG. 15 is a graph showing an unclean signal detected by the unclean detection sensor 322 with the passage of time.

When a leakage current is generated while an AC bias voltage is applied to the charging roller 34 from the AC bias voltage applying section 315, as shown in FIG. 14, a leakage current value monitored by the current monitoring circuit 320 rises in a phenomenon 1 region and a phenomenon 2 region. On the other hand, as shown in FIG. 15, when uncleanness occurs by, for example, adhering recording liquid (ink) onto the surface of the transport belt 31, an unclean signal detected by the unclean detection sensor 322 rises in the phenomenon 1 region, and when the uncleanness on the surface of the transport belt 31 does not change with the passage of time, as shown in the phenomenon 2 region, an unclean signal detected by the unclean detection sensor 322 does not change. In FIG. 15, a circuit of the unclean detection sensor 322 is designed so that an unclean signal detected by the unclean detection sensor 322 rises when the uncleanness on the surface of the transport belt 31 is detected.

FIG. 16 is a table showing the monitored leakage current value shown in FIG. 14 and the detected unclean signal shown in FIG. 15. In FIG. 16, "x" shows a rise and "o" shows a non-change. As shown in FIG. 16, when a leakage current value monitored by the current monitoring circuit 320 rises (shown by "x") and an unclean signal detected by the unclean detection sensor 322 rises (shown by "x") in the phenomenon 1 region, it can be determined that a leakage current is generated by the uncleanness of the surface of the transport belt 31. Therefore, in the phenomenon 1 region, it is determined that the uncleanness of the surface of the transport belt 31 is detected instead of detecting a real leakage current.

On the other hand, when a leakage current value monitored by the current monitoring circuit 320 rises (shown by "x") and an unclean signal detected by the unclean detection sensor 322 does not change (shown by "o") in the phenomenon 2 region, it can be determined that a leakage current is generated regardless of the uncleanness of the surface of the transport belt 31. Therefore, in the phenomenon 2 region, it is determined that the leakage current value is detected regardless of the uncleanness of the surface of the transport belt 31.

Figure 17:
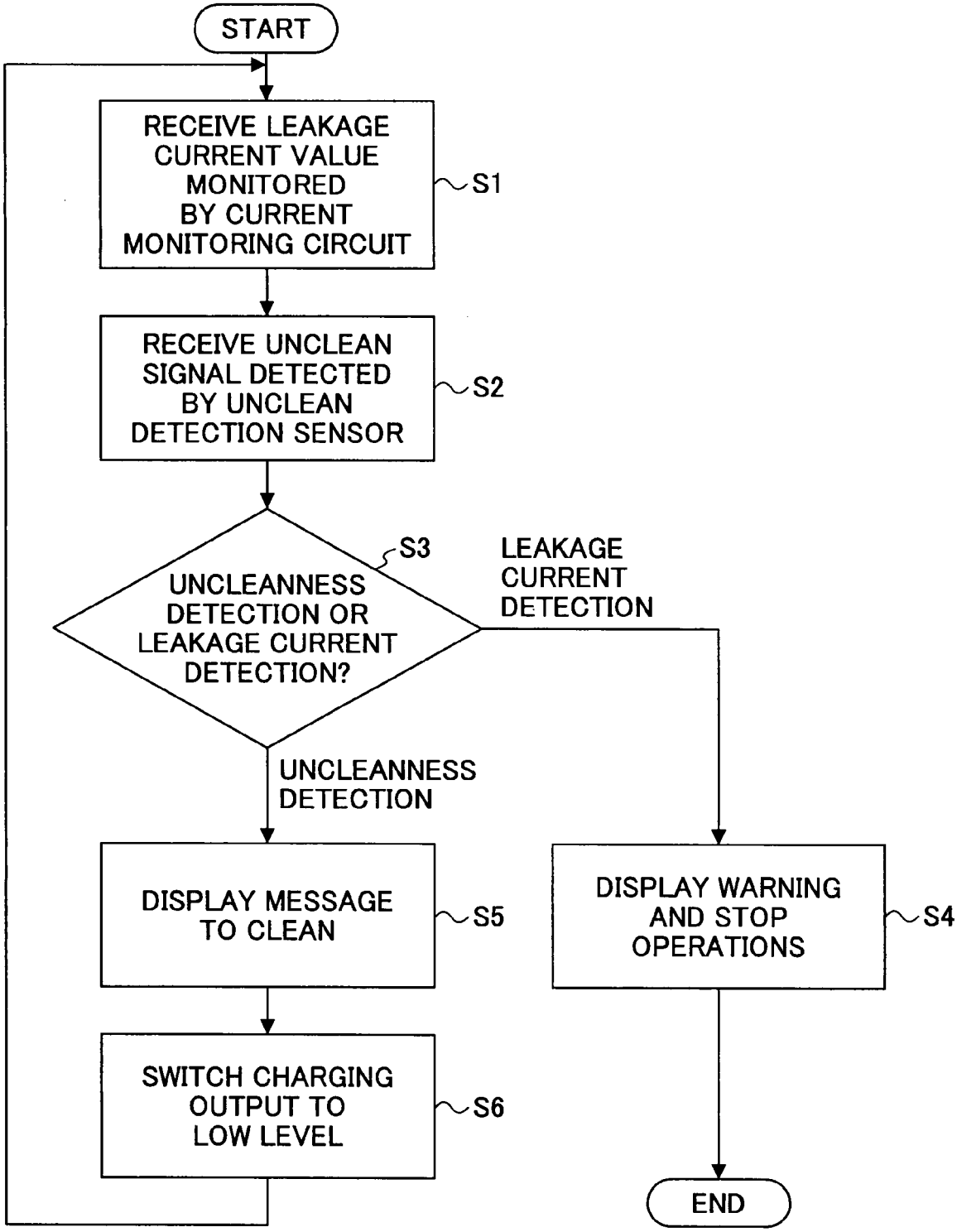
FIG. 17 is a flowchart showing leakage current determination processes by the main controller shown in FIG. 13.

FIG. 17 is a flowchart showing leakage current determination processes by the main controller 301. Referring to FIG. 17, the leakage current determination processes are described.

First, the main controller 301 receives a leakage current value monitored by the current monitoring circuit 320 (S1). Next, the main controller 301 receives an unclean signal detected by the unclean detection sensor 322 (S2). Then the main controller 301 determines whether the combination of the leakage current value with the unclean signal is uncleanness detection or leakage current detection by referring to the table shown in FIG. 16 (S3).

When the determined result is the leakage current detection, the main controller 301 displays a warning on the operating panel 319 and stops the operations of the image forming apparatus (S4). The warning can be displayed on a display of a host information processing apparatus connected to the image forming apparatus via a printer driver of the host information processing apparatus. With this, the host information processing apparatus can stop the operations of the image forming apparatus. Only when a real leakage current is detected, the warning is displayed and the operations of the image forming apparatus are stopped. With this, the downtime of the image forming apparatus can be reduced.

When the determined result is the uncleanness detection, the main controller 301 displays a message on the operating panel 319 to clean the surface of the transport belt 31 or the charging roller 34 (S5). When the surface of the transport belt 31 or the charging roller 34 is cleaned, the performance of the image forming apparatus can be maintained with the passage of time.

Then the main controller 301 switches a charging output from the AC bias voltage applying section 315 to a low level (S6). When the uncleanness of the surface of the transport belt 31 is detected, resistance values of the transport belt 31 and/or the charging roller 34 are made lower than corresponding predetermined values. Therefore, when the charging output is switched to the low level, the leakage current value may be reduced. In this case, the charging output has two levels, a high level and the low level.

In FIG. 17, when a leakage current value is not detected and an unclean signal is not detected, since the image forming apparatus normally operates, the description is omitted.

The image forming apparatus in the embodiments of the present invention can be a MFP (multifunctional peripheral), a printer, or a facsimile.

Further, the present invention is not limited to the specifically disclosed embodiments, and variations and modifications may be made without departing from the scope of the present invention.

The present invention is based on Japanese Priority Patent Application No. 2006-227097, filed on Aug. 23, 2006, with the Japanese Patent Office, the entire contents of which are hereby incorporated herein by reference.

What is claimed is:

1. A sheet transport device, comprising:

a transport belt that rotates around rollers to transport a sheet by attaching the sheet on the transport belt by an electrostatic force; and a charging unit including a transport guiding member that guides the sheet being transported to the transport belt, said transport guiding member including a charging member that charges the transport belt; wherein the charging unit including the transport guiding member is configured to detach together with the transport guiding member as one unit from the transport belt.

2. The sheet transport device as claimed in claim 1, wherein:

the charging unit further includes a cleaning unit, disposed at an upstream side of the charging member, to clean the surface of the transport belt.

3. The sheet transport device as claimed in claim 2, wherein:

the cleaning unit has a cleaning roller capable of absorbing liquid.

4. The sheet transport device as claimed in claim 2, wherein:

the charging unit further includes a cleaning member for cleaning the cleaning unit.

5. The sheet transport device as claimed in claim 1, wherein:

the charging unit further includes a unit case that contains the charging unit and electrodes for applying a voltage to the charging member.

6. The sheet transport device as claimed in claim 1, further comprising:

a leakage current monitoring unit for monitoring a leakage current from a high voltage power source that generates a high voltage to be applied to the charging member;

a uncleanness detecting unit for detecting uncleanness of the surface of the transport belt; and a determining unit for determining whether the leakage current from the high voltage power source is caused by the uncleanness of the surface of the transport belt based on a result monitored by the leakage current monitoring unit and a result detected by the uncleanness detecting unit.

7. The sheet transport device as claimed in claim 6, further comprising:

a warning outputting unit for outputting a warning when the leakage current detected by the leakage current detecting unit is not caused by the uncleanness of the surface of the transport belt.

8. The sheet transport device as claimed in claim 6, further comprising:

a message outputting unit for outputting a message which requests a user to clean the surface of the transport belt when the leakage current detected by the leakage current detecting unit is caused by the uncleanness of the surface of the transport belt.

9. The sheet transport device as claimed in claim 8, wherein:

when the leakage current detected by the leakage current detecting unit is caused by the uncleanness of the surface of the transport belt, a charging output to the charging member from the high voltage power source is switched to a relatively low level.

10. The sheet transport device as claimed in claim 1, wherein:

the charging member is disposed between the transport guiding member and the transport belt, and the transport guiding member and the transport belt face each other.

11. The sheet transport device as claimed in claim 1, wherein the charging unit further includes a pressure applying unit that applies pressure to the charging member toward the transport belt so that the charging member contacts the transport belt.

12. An image forming apparatus, comprising:

a sheet transport device including a transport belt that rotates around rollers to transport a sheet by attaching the sheet on the transport belt by an electrostatic force, a charging unit including a transport guiding member that guides the sheet being transported to the transport belt, said transport guiding member including a charging member that charges the transport belt, and a pressure applying unit that applies pressure toward the transport belt so that the charging member contacts the transport belt; and an image forming unit configured to form an image on the sheet transported by the sheet transport device; wherein the charging unit including the transport guiding member is configured to detach together with the transport guiding member as one unit from the transport belt.

13. The image forming apparatus as claimed in claim 12, wherein:

the charging unit includes a cleaning unit, disposed at an upstream side of the charging member, for cleaning the surface of the transport belt;

the cleaning unit has a cleaning roller capable of absorbing liquid; and the charging unit further includes a cleaning member for cleaning the cleaning unit.

14. The image forming apparatus as claimed in claim 12, wherein:

the charging unit further includes a unit case that contains the charging unit and electrodes for applying a voltage to the charging member.

15. The image forming apparatus as claimed in claim 12, wherein the charging member is disposed in the transport guiding member.

16. The image forming apparatus as claimed in claim 12, further comprising:

a leakage current monitoring unit for monitoring a leakage current from a high voltage power source that generates a high voltage to be applied to the charging member;

a uncleanness detecting unit for detecting uncleanness of the surface of the transport belt; and a determining unit for determining whether the leakage current from the high voltage power source is caused by the uncleanness of the surface of the transport belt based on a result monitored by the leakage current monitoring unit and a result detected by the uncleanness detecting unit.

17. The image forming apparatus as claimed in claim 16, further comprising:

a warning outputting unit for outputting a warning when the leakage current detected by the leakage current detecting unit is not caused by the uncleanness of the surface of the transport belt; and a message outputting unit for outputting a message which requests a user to clean the surface of the transport belt when the leakage current detected by the leakage current detecting unit is caused by the uncleanness of the surface of the transport belt.

18. The image forming apparatus as claimed in claim 17 wherein:

when the leakage current detected by the leakage current detecting unit is caused by the uncleanness of the surface of the transport belt, a charging output to the charging member from the high voltage power source is switched to a relatively low level.

* * * * *